US007410170B1

(12) United States Patent
Roach et al.

(10) Patent No.: US 7,410,170 B1
(45) Date of Patent: Aug. 12, 2008

(54) GAME HAVING AN ELECTRONIC INSTRUCTION UNIT

(75) Inventors: Alan Roach, Wilbraham, MA (US); Peter Kullgren, Ludlow, MA (US); Samuel C. Unsicker, Woodridge, IL (US)

(73) Assignees: Hasbro, Inc., Pawtucket, RI (US); Big Monster Toys, LLC., Chicago, IL (US)

( * ) Notice: Subject to any disclaimer, the term of this patent is extended or adjusted under 35 U.S.C. 154(b) by 0 days.

(21) Appl. No.: 11/426,420

(22) Filed: Jun. 26, 2006

(51) Int. Cl.
*A63F 1/00* (2006.01)

(52) U.S. Cl. ..... 273/146; 273/268; 273/273; 273/303

(58) Field of Classification Search ..... 273/146, 273/148 R, 429–432, 292, 268, 269, 273, 273/303
See application file for complete search history.

(56) References Cited

U.S. PATENT DOCUMENTS

| | | | | | |
|---|---|---|---|---|---|
| 2,560,187 | A | * | 7/1951 | Post | 273/146 |
| 4,240,638 | A | | 12/1980 | Morrison et al. | 273/237 |
| 4,359,227 | A | * | 11/1982 | Porciello | 273/268 |
| 4,363,482 | A | | 12/1982 | Goldfarb | 463/9 |
| 4,363,842 | A | * | 12/1982 | Nelson | 428/35.8 |
| 4,421,315 | A | * | 12/1983 | Cutler | 273/268 |
| 4,443,012 | A | * | 4/1984 | Makovic et al. | 273/292 |
| 4,572,513 | A | | 2/1986 | Evans | 273/242 |
| 4,669,728 | A | | 6/1987 | Carden | 273/138 A |
| 4,770,416 | A | | 9/1988 | Shimizu et al. | 273/1 GC |
| 4,799,678 | A | * | 1/1989 | Terzian et al. | 463/32 |
| 4,957,291 | A | | 9/1990 | Miffitt et al. | 273/153 R |
| 4,969,647 | A | | 11/1990 | Mical et al. | 273/85 G |
| 5,009,419 | A | | 4/1991 | Streeter | 273/454 |
| 5,011,156 | A | | 4/1991 | LaChance, Jr. et al. | 273/237 |
| D320,624 | S | | 10/1991 | Taylor | D21/13 |
| 5,120,065 | A | | 6/1992 | Driscoll et al. | 273/237 |
| 5,277,429 | A | | 1/1994 | Smith, III | 273/237 |

(Continued)

OTHER PUBLICATIONS

U.S. Appl. No. 10/941,590, entitled "Electronic Sequence Matching Game and Method of Game Play Using Same," filed Sep. 15, 2004 (47 pages).

(Continued)

*Primary Examiner*—William M. Pierce
(74) *Attorney, Agent, or Firm*—Marshall, Gerstein & Borun LLP

(57) ABSTRACT

A multiplayer game in which players are dealt cards from a deck of game cards having indicia thereon corresponding to combinations typically used in the traditional Yahtzee game that are to be matched by the dice rolls of the players. During the course of a player's turn, the player actuates an instruction unit to start a timer setting a time limit within which the player rolls the dice multiple times in an effort to match one of the combinations on the cards in the player's hand. If the player matches a combination on one of the cards, the player actuates the instruction unit a second time to stop the timer and to receive a win instruction from the instruction unit. If the player does not match any of the combinations on the cards within the time limit, the instruction unit outputs a loss instruction to be followed by the player. The sequence may continue until one player has discarded all of the game cards in the player's hand onto the discard pile.

13 Claims, 11 Drawing Sheets

U.S. PATENT DOCUMENTS

| | | | | |
|---|---|---|---|---|
| 5,411,271 | A | 5/1995 | Mirando | 273/434 |
| D363,320 | S | 10/1995 | Barthelemy et al. | D21/48 |
| 5,478,240 | A | 12/1995 | Cogliano | 434/327 |
| 5,685,776 | A | 11/1997 | Stambolic et al. | 463/46 |
| 5,816,580 | A | 10/1998 | Osborne et al. | 273/454 |
| 5,839,976 | A | 11/1998 | Darr | 473/414 |
| 5,855,513 | A | 1/1999 | Lam | 463/9 |
| 5,868,391 | A * | 2/1999 | Abood | 273/292 |
| 5,893,798 | A | 4/1999 | Stambolic et al. | 463/46 |
| 5,906,369 | A | 5/1999 | Brennan et al. | 273/238 |
| 6,086,478 | A | 7/2000 | Klitsner et al. | 463/35 |
| 6,120,032 | A * | 9/2000 | Wissinger | 273/430 |
| 6,210,278 | B1 | 4/2001 | Klitsner | 463/35 |
| 6,341,779 | B1 * | 1/2002 | Merritt | 273/292 |
| 6,464,602 | B1 * | 10/2002 | Rottger | 473/571 |
| 6,540,615 | B2 | 4/2003 | Tanaka et al. | 463/44 |
| 6,848,992 | B2 | 2/2005 | Adams | 463/9 |
| 6,942,218 | B2 * | 9/2005 | Davis et al. | 273/268 |
| 2001/0009866 | A1 | 7/2001 | Klitsner et al. | 463/35 |
| 2002/0111202 | A1 | 8/2002 | Annis et al. | 463/7 |
| 2005/0035549 | A1 * | 2/2005 | Zeng | 273/292 |
| 2006/0043672 | A1 * | 3/2006 | Gal | 273/146 |

OTHER PUBLICATIONS

U.S. Appl. No. 10/947,736, entitled "Game Having an Electronic Instruction Unit," filed Sep. 23, 2004 (42 pages).

U.S. Appl. No. 11/181,092, entitled "Hand-Held Electronic Game Device," filed Jul. 13, 2005 (29 pages).

U.S. Appl. No. 11/194,508, entitled "Electronic Tag Game and Instruction Unit," filed Aug. 1, 2005 (35 pages).

U.S. Appl. No. 11/421,647, entitled "Game Having an Electronic Instruction Unit with a Mechanical Die Agitator" filed Jun. 1, 2006 (37 pages).

* cited by examiner

80

82 84 86 88 90

| File No. | Filename | Type | Phrase/Description | Estimated Time (secs.) |
|---|---|---|---|---|
| 01 | Poweron | MUS | Intro music when instruction unit is turned on | 1.0 |
| 02 | Idleloop | MUS | Music that plays during idle | 4.0 |
| 03 | Playloop | MUS | Music that plays during timer | 4.0 |
| 04 | FanfareIntro | MUS | Music that plays at the beginning of the Win | 0.5 |
| 05 | FanfareWin | MUS/ NAR | Music and voice file that plays to announce winner | 4.0 |
| 06 | Ding | SFX | Ding – Bell sound | 0.1 |
| 07 | Buzz | SFX | Buzz – Buzzer error sound | 0.1 |
| 08 | LetsPlay | NAR | Let's play | 0.8 |
| 09 | GName | NAR | Yahtzee Turbo (game name) | 0.8 |
| 10 | Dontforget | NAR | Don't forget | 0.8 |
| 11 | Taptostart | NAR | Tap the big die once to start | 2.2 |
| 12 | LetsRoll | NAR | Let's roll | 0.5 |
| 13 | ReadyGo | NAR | Ready? Go! | 0.8 |
| 14 | 3xinarow | NAR | That's 3 times in a row | 1.5 |
| 15 | Youbeatclock | NAR | you beat the clock | 1.5 |
| 16 | Speedup | NAR | I'm going to speed things up a bit | 1.7 |
| 17 | Clockwon | NAR | the clock has won | 1.5 |
| 18 | Slowdown | NAR | I think it's time to slow things down | 1.7 |
| 19 | Discard | NAR | Discard | 0.5 |
| 20 | Yourtopcard | NAR | your top card | 0.6 |
| 21 | And | NAR | and | 0.3 |
| 22 | Use3rolls | NAR | use 3 rolls only to try for a Yahtzee | 1.5 |
| 23 | 2cards | NAR | 2 cards | 1.0 |
| 24 | Takeanother | NAR | take another turn | 0.8 |
| 25 | drawanother | NAR | draw another card for | 0.8 |
| 26 | Anyplayer | NAR | any player | 0.8 |
| 27 | Theplayer | NAR | the player | 0.8 |
| 28 | Onyourleft | NAR | on your left | 1.0 |
| 29 | onyourright | NAR | on your right | 1.0 |
| 30 | Give | NAR | Give | 0.3 |
| 31 | To | NAR | to | 0.3 |
| 32 | Keep | NAR | Keep | 0.3 |
| 33 | Tryagain | NAR | try again on your next turn | 1.0 |
| 34 | Try | NAR | Try | 0.3 |

*FIG. 3A*

80

82 84 86 88 90

| File No. | Filename | Type | Phrase/Description | Estimated Time (secs.) |
|---|---|---|---|---|
| 35 | Anothercard | NAR | another card in your hand | 1.0 |
| 36 | Thatcard | NAR | that card again | 0.7 |
| 37 | otherplayercard | NAR | a card from another player's hand | 1.2 |
| 38 | drawanother | NAR | draw another | 0.6 |
| 39 | Again | NAR | again | 0.3 |
| 40 | Draw2more | NAR | Draw 2 more cards | 1.2 |
| 41 | Swap | NAR | Swap | 0.3 |
| 42 | anothertop | NAR | with another player's top card | 1.0 |
| 43 | takeanother | NAR | Take a card from another player | 1.0 |
| 44 | Ycomment1 | NAR | Nice Roll! | 0.7 |
| 45 | Ycomment2 | NAR | Way to go! | 0.7 |
| 46 | Ycomment3 | NAR | Awesome job! | 0.7 |
| 47 | Ycomment4 | NAR | You beat the clock! | 0.7 |
| 48 | Ycomment5 | NAR | Outstanding! | 0.7 |
| 49 | Ycomment6 | NAR | Rock those Dice! | 0.7 |
| 50 | Ycomment7 | NAR | Excellent! | 0.7 |
| 51 | Ycomment8 | NAR | You made it! | 0.7 |
| 52 | Ncomment1 | NAR | Ooohh, too bad! | 0.7 |
| 53 | Ncomment2 | NAR | Times UP! | 0.7 |
| 54 | Ncomment3 | NAR | Nice Try… | 0.7 |
| 55 | Ncomment4 | NAR | Ahh, too late! | 0.7 |
| 56 | Ncomment5 | NAR | Ooh, didn't quite make it. | 1.0 |
| 57 | Ncomment6 | NAR | Looks like the dice didn't cooperate | 1.2 |
| 58 | Ncomment7 | NAR | Better luck next time | 1.2 |
| 59 | Ncomment8 | NAR | Time ran out | 1.0 |
| 60 | Playloop2 | MUS | Play when Timer Table 2 is used | 4.0 |
| 61 | Playloop3 | MUS | Play when Timer Table 3 is used | 4.0 |
| 62 | Nextturn | NAR | Pass the dice to the next player | 1.2 |
| 63 | YahtzeeInst | NAR | If all 5 dice are the same color, Discard another card | 2.2 |
| 64 | Dontusetimer | NAR | Don't use the timer | 0.8 |
| 65 | sameplayer | NAR | the same player | 0.7 |
| 66 | After3 | NAR | after 3 rolls | 0.7 |
| 67 | Fanfare | MUS | Yahtzee Fanfare | 4.0 |

*FIG. 3B*

92

| 94 Occurrence | 96 File Nos. | 98 Phrase |
|---|---|---|
| 1 | 01/08/09 | <Poweron SFX>/Let's Play/Yahtzee Turbo |
| 2 | 12/03/06 | Let's Roll /MUS Playloop/Ding! |
| 3 | 45/67/19/20/21/22 | Way to Go!/ MUSYahtzeeIntro/ Discard/ your top card/and /use 3 rolls only to try for a Yahtzee/ |

*FIG. 4*

160 Timer Table 1 (Default)

| Time in Seconds |
|---|
| 15 |
| 18 |
| 17 |
| 16 |
| 20 |
| 14 |
| 16 |
| 15 |
| 17 |
| 22 |
| 13 |
| 19 |

162 Timer Table 2 (Fast)

| Time in Seconds |
|---|
| 13 |
| 12 |
| 14 |
| 10 |
| 12 |
| 9 |
| 11 |
| 10 |
| 9 |
| 13 |
| 15 |
| 12 |

164 Timer Table 3 (Slow)

| Time in Seconds |
|---|
| 20 |
| 22 |
| 23 |
| 25 |
| 21 |
| 28 |
| 23 |
| 25 |
| 21 |
| 26 |
| 20 |
| 19 |

*FIG. 6*

130
CHANGE TIMER TABLE?
N
Y
132
UPDATE TIMERTABLE AND RESET RESULTS COUNTERS
134
PLAY TIMER CHANGE PROMPT
140
REPLAY LAST COMMENT AND INSTRUCTION
PLAY IDLE MUSIC
136
PLAY REMINDER MESSAGE
146
138
REPLAY SWITCH PRESSED?
Y
N
142
DIE SWITCH PRESSED?
N
TIME OUT?
N
Y
144
Y
148
B
N
PRESSED 2 SECS?
Y
150
PLAY WINNER ANNOUNCEMENT
152
ENTER SLEEP MODE
154
N
DIE SWITCH PRESSED?
Y
C

170

172 174 176

| Phrase No. | File Nos. | Phrase |
|---|---|---|
| 1. | 44/19/20/62/ | Nice roll!/Discard/ your top card/<pause 200ms>/Pass the dice to the next player |
| 2. | 45/67/19/20/21/22/64/63/66/62 | Way to go!/MUS YahtzeeFanfare / Discard/ your top card/and /use 3 rolls only to try for a Yahtzee/<pause 200ms>/Don't use the timer/ <pause 200ms>/If all 5 dice are the same color, Discard another card/ <pause 200ms> / after 3 rolls /pass the dice to the next player |
| 3. | 46/19/20/21/65/24 | Awesome job!/Discard/ your top card/and / the same player / take another turn |
| 4. | 47/19/20/21/62 | You beat the clock!/Discard/ your top card / and / pass the dice to the next player |
| 5. | 48/30/20/31/26/21/62 | Outstanding!/Give /your top card/ to /any player / <pause 200ms> / and / pass the dice to the next player |
| 6. | 49/19/23/21/62 | Rock those dice!/Discard /2 cards / and / pass the dice to the next player |
| 7. | 50/19/20/21/65/24 | Excellent!/Discard /your top card /and /the same player / take another turn |
| 8. | 51/67/19/20/21/22/64/63/66/62 | You made it!/MUS YahtzeeFanfare/ Discard/ your top card/and /use 3 rolls only to try for a Yahtzee/<pause 200ms>/Don't use the timer/ <pause 200ms>/If all 5 dice are the same color, Discard another card/ <pause 200ms> / after 3 rolls /pass the dice to the next player |
| 9. | 44/19/23/21/62 | Nice roll!/Discard /2 cards /and / pass the dice to the next player |
| 10. | 45/19/20/21/25/26/21/62 | Way to go!/Discard /your top card/and /draw another card for / any player / <pause 200ms> /and / pass the dice to the next player |
| 11. | 46/19/20/21/25/27/28/21/62 | Awesome job!/Discard/your top card /and/ draw another card for / the player/ on your left / <pause 200ms> /and / pass the dice to the next player |
| 12. | 47/30/20/31/27/29/21/62 | You beat the clock!/Give /your top card/ to/ the player /on your right / and / pass the dice to the next player |
| 13. | 48/19/20/21/65/24 | Outstanding!/Discard / your top card /and / the same player / take another turn |
| 14. | 49/67/19/20/21/22/64/63/66/62 | Rock those dice!/MUS YahtzeeFanfare / Discard/ your top card/and /use 3 rolls only to try for a Yahtzee/<pause 200ms>/Don't use the timer/ <pause 200ms>/If all 5 dice are the same color, Discard another card/ <pause 200ms> / after 3 rolls /pass the dice to the next player |
| 15. | 50/19/20/21/62 | Excellent!/Discard/ your top card/<pause 200ms>/and/Pass the dice to the next player |
| 16. | 51/30/20/31/27/28/21/62 | You made it!/Give /your top card/ to/ the player on /your left / and / pass the dice to the next player |

*FIG. 7*

180

182 184 186

| Occurrence | File Nos. | Phrase |
|---|---|---|
| 1 | 67/19/20/21/22/ 64/63/66/62 | MUSFanfareIntro/ Discard/ your top card/and /use 3 rolls only to try for a Yahtzee/<pause 200ms>/Don't use the timer/ <pause 200ms>/If all 5 dice are the same color, Discard another card/ <pause 200ms> / after 3 rolls /pass the dice to the next player |
| 2 | 67/19/20/21/22/ 63/66/62 | MUSFanfareIntro/ Discard/ your top card/and /use 3 rolls only to try for a Yahtzee/<pause 200ms>/ If all 5 dice are the same color, Discard another card/ <pause 200ms>/ after 3 rolls /pass the dice to the next player |
| 3 | 67/19/20/21/22/ 63/21/62 | MUSFanfareIntro/ Discard/ your top card/and /use 3 rolls only to try for a Yahtzee/ If all 5 dice are the same color, Discard another card/ <pause 200ms>/ and /pass the dice to the next player |
| 4 | 67/19/20/21/22/ 21/62 | MUSFanfareIntro/ Discard/ your top card/and /use 3 rolls only to try for a Yahtzee/<pause 200ms>/ and /pass the dice to the next player |

*FIG. 8*

190

192 194 196

| Phrase No. | File Nos. | Phrase |
|---|---|---|
| 1. | 52/32/20/21/33/62 | Ooohh, too bad!/Keep /your top card/and/ try again on your next turn / <pause 200ms> / pass the dice to the next player |
| 2. | 53/65/24/34/35 | Times UP!/ the same player /<pause 200ms> take another turn /<pause 200ms> /Try/ another card in your hand |
| 3. | 54/19/37/21/62 | Nice try . . ./Discard/ a card from another player's hand / and / pass the dice to the next player |
| 4. | 55/65/24/34/20/39 | Ahh, too late!/ the same player /<pause 200ms> take another turn / <pause 200ms> /Try /your top card/ again |
| 5. | 56/32/20/21/38/62 | Ooh, didn't quite make it./Keep /your top card/ and /draw another/ <pause 200ms>/ pass the dice to the next player |
| 6. | 57/65/24/34/20/39 | Looks like the dice didn't cooperate./ the same player /<pause 200ms> take another turn / <pause 200ms> Try /your top card/ again |
| 7. | 58/40/21/62 | Better luck next time./Draw 2 more cards/ and / pass the dice to the next player |
| 8. | 59/32/20/21/38/62 | Timer ran out./Keep/ your top card/ and / draw another / <pause 200ms> / pass the dice to the next player |
| 9. | 52/19/37/21/62 | Ooohh, too bad!/Discard/ a card from another player's hand / and / pass the dice to the next player |
| 10. | 53/41/20/42/21/62 | Times UP!/ Swap /your top card/ with another player's top card / and / pass the dice to the next player |
| 11. | 54/32/20/21/38/21/62 | Nice try . . ./Keep /your top card/ and /draw another / and / pass the dice to the next player |
| 12. | 55/40/21/62 | Ahh, too late!/ Draw 2 more cards / and / pass the dice to the next player |
| 13. | 56/65/34/20/39 | Ooh, didn't quite make it./The same player/ Try / your top card/ again |
| 14. | 57/32/20/21/33/62 | Looks like the dice didn't cooperate./ Keep/ your top card /and/ try again on your next turn / <pause 200ms> / pass the dice to the next player |
| 15. | 58/43/21/62 | Better luck next time./Take a card from another player / and / pass the dice to the next player |
| 16. | 59/19/37/21/62 | Timer ran out./Discard/ a card from another player's hand / and / pass the dice to the next player |

*FIG. 9*

GAME HAVING AN ELECTRONIC INSTRUCTION UNIT

BACKGROUND

The patent is directed to a multi-player game, and more particularly to a multi-player game having a plurality of dice, a plurality of game cards, and an electronic instruction unit providing game instructions to the players and functioning as a timer during the course of gameplay.

Various games having dice and playing cards associated therewith have been previously described. For example, U.S. Pat. No. 5,997,000 to Nakano et al. discloses a combined dice and card game utilizing three conventional six-sided dice and a twenty-four card deck formed by removing all cards other than ace, two, three, four, five, and six of a conventional four-suit fifty-two playing card deck. In a preferred embodiment, one of a plurality of players is selected as the banker and posts a fixed sum of money or chips as a bank. The remaining players place bets against the bank. Each player and the banker then receive three cards dealt from the ace through six stripped playing card deck, and subsequently discard one card, leaving each player and the banker with two cards, ranging from ace through six. The banker, and subsequently the players, then roll the dice and attempt to roll an automatically winning dice combination or to establish a winning point, while attempting to avoid rolling an automatically losing dice combination. The banker and the players may, upon obtaining certain predetermined card and dice combinations, utilize their cards to improve or increase a rolled dice point.

U.S. Pat. No. 4,236,719 to Kerr discloses a game involving the spelling of words, and played competitively by two to four participants. The game is comprised of a series of elongated word cards having a word printed on one face thereof, multi-apertured holders adapted to accommodate several of said word cards, elongated blank cards adapted to cover said word cards, a multitude of flat elongated shutters adapted to be vertically positioned to separately occlude individual apertures of said holders, a first series of playing pieces serving to expedite the playing of the game, a second series of playing pieces which facilitate scorekeeping, and a number-selecting means such as a pair of dice.

Further, U.S. Pat. No. 6,341,779 to Merritt discloses a mathematical card and dice game comprising a deck of cards, a set of three dice, and a timing device. The deck of cards is divided into four suits of fifteen cards each, ten of which are numbered one through ten, the remaining five non-numeric cards having letters which can take on any value as defined by the players prior to the game. A predetermined number of cards are dealt to players who use the values of the three dice rolled, common mathematical operations such as addition, subtraction, multiplication, and division, and their knowledge of math to make mathematical relationships that equate to the value of cards in their hands within a predetermined amount of time as tracked by a timing device. A successful match occurs when the card value equals the numeric result of a mathematical operation involving all three dice. Players place successful matching cards face down until the end of the round, when the time limit is up, wherein they turn the cards over and must be able to successfully explain the relationship the card value has to the dice values. Players take turns rolling the dice and starting the timer between rounds. The first player to discard all their cards is the winner. Penalty cards are assessed when players cannot correctly explain the relationship the card has to the dice or when they cannot discard any card during a round.

SUMMARY OF THE INVENTION

In one aspect, the invention is directed to a game for multiple players having a plurality of dice each having dice indicia disposed on the faces thereof, an instruction unit, and a plurality of game cards each having gameplay indicia disposed thereon, the gameplay indicia on each game card comprising a combination of the dice indicia on the dice. The instruction unit includes an input device and an output device, with the instruction unit being actuated by a player at the input device and initiating a timer for a time period for a player's turn. The instruction unit causes the output device to output a sensory perceptible indication of the beginning and the ending of the time period for the player's turn in response to detecting the actuation of the input device.

In another aspect, the invention is directed to an instruction unit for a game having an input device, an output device, and a controller operatively coupled to the input device and the output device. The controller is programmed to initiate a timer for the time period for a player's turn in response to detecting the actuation of the input device, and to cause the output device to output a sensory perceptible indication of the beginning and the ending of the time period for the player's turn in response to detecting the actuation of the input device.

In a further aspect, the invention is directed to a method of gameplay for a game for a plurality of players (See, e.g., FIG. 10, routine 200). The method includes providing an instruction unit, a plurality of dice each having dice indicia disposed on the faces thereof, and a deck of game cards, wherein each game card has gameplay indicia comprising a combination of the dice indicia disposed thereon (FIG. 10, block 202). The method further comprises distributing a plurality of the game cards to each participant of the game (FIG. 10, block 204), each player in turn actuating the instruction unit to initiate a timer with a time period for the player's turn (FIG. 10, block 208), rolling the dice during the time period (FIG. 10, block 210) until the combination of dice indicia on the top faces of the rolled dice matches the combination of dice indicia on one of the game cards distributed to the player (FIG. 10, block 214) or until the time period for the player's turn expires (FIG. 10, block 212), and the player actuating the instruction unit a second time to stop the timer (FIG. 10, block 216) if the combination of dice indicia on the top faces of the rolled dice matches the combination of dice indicia on one of the game cards distributed to the player (FIG. 10, block 214).

In an additional aspect, the invention is directed to a method of gameplay for a game for a plurality of players (See, e.g., FIG. 10, routine 200). The method includes distributing a plurality of game cards to each player of the game, wherein each game card has gameplay indicia comprising a combination of dice indicia disposed on the faces of a plurality of dice (FIG. 10, block 204), sequential players actuating an instruction unit to initiate a time period for the player's turn (FIG. 10, block 208), and rolling the dice during the time period in an attempt to match the combination of dice indicia on one of the game cards with the combination of indicia on the top faces of the rolled dice (FIG. 10, block 210). The method further includes actuating the instruction unit (FIG. 10, block 216) if the combination of dice indicia on the top faces of the rolled dice matches the combination of dice indicia on one of the game cards (FIG. 10, block 214) before the time period for the player's turn expires (FIG. 10, block 212), and following the game instructions output by the instruction unit (FIG. 10, block 220), wherein the game instructions are determined based on whether the player actuated the instruction unit a second time before the expiration of the time period (FIG. 10, block 212).

Additional aspects of the invention are defined by the claims of this patent.

BRIEF DESCRIPTION OF THE DRAWING

FIGS. 3A and 3B are a chart of sound files and corresponding phrases or descriptions that may be stored in the instruction unit of FIG. 1 and broadcast by the instruction unit during the game;

FIG. 4 is a chart of phrases constructed from the sound files of the chart of FIGS. 3A and 3B that may be broadcast by the electronic instruction unit during a demonstration mode;

FIG. 6 is a plurality of charts of timer tables that may be implemented in the electronic instruction unit during the game to control the duration of a player's turn;

FIG. 7 is a chart of phrases constructed from the sound files of the chart of FIGS. 3A and 3B that may be broadcast by the electronic instruction unit when a player actuates the die switch within a time limit from the timer tables of FIG. 6 during the game;

FIG. 8 is a chart of Yahtzee instruction phrases constructed from the sound files of the chart of FIGS. 3A and 3B that may be broadcast by the electronic instruction unit during the game;

FIG. 9 is a chart of phrases constructed from the sound files of the chart of FIGS. 3A and 3B that may be broadcast by the electronic instruction unit when a player fails to actuate the die switch within a time limit from the timer tables of FIG. 6 during the game.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
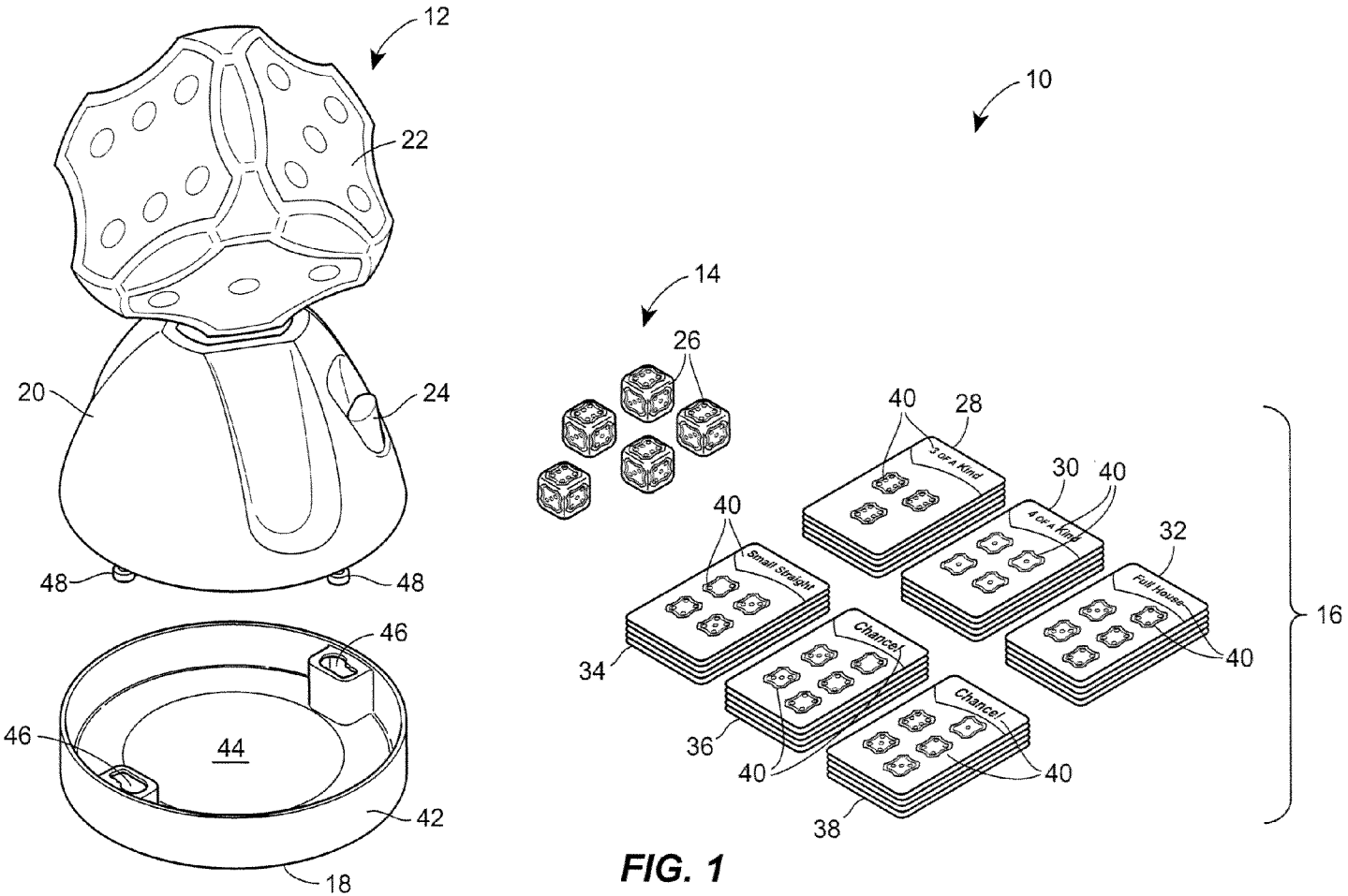
FIG. 1 is a perspective view of an embodiment of game having an electronic instruction unit in accordance with the invention.
Figure 10:
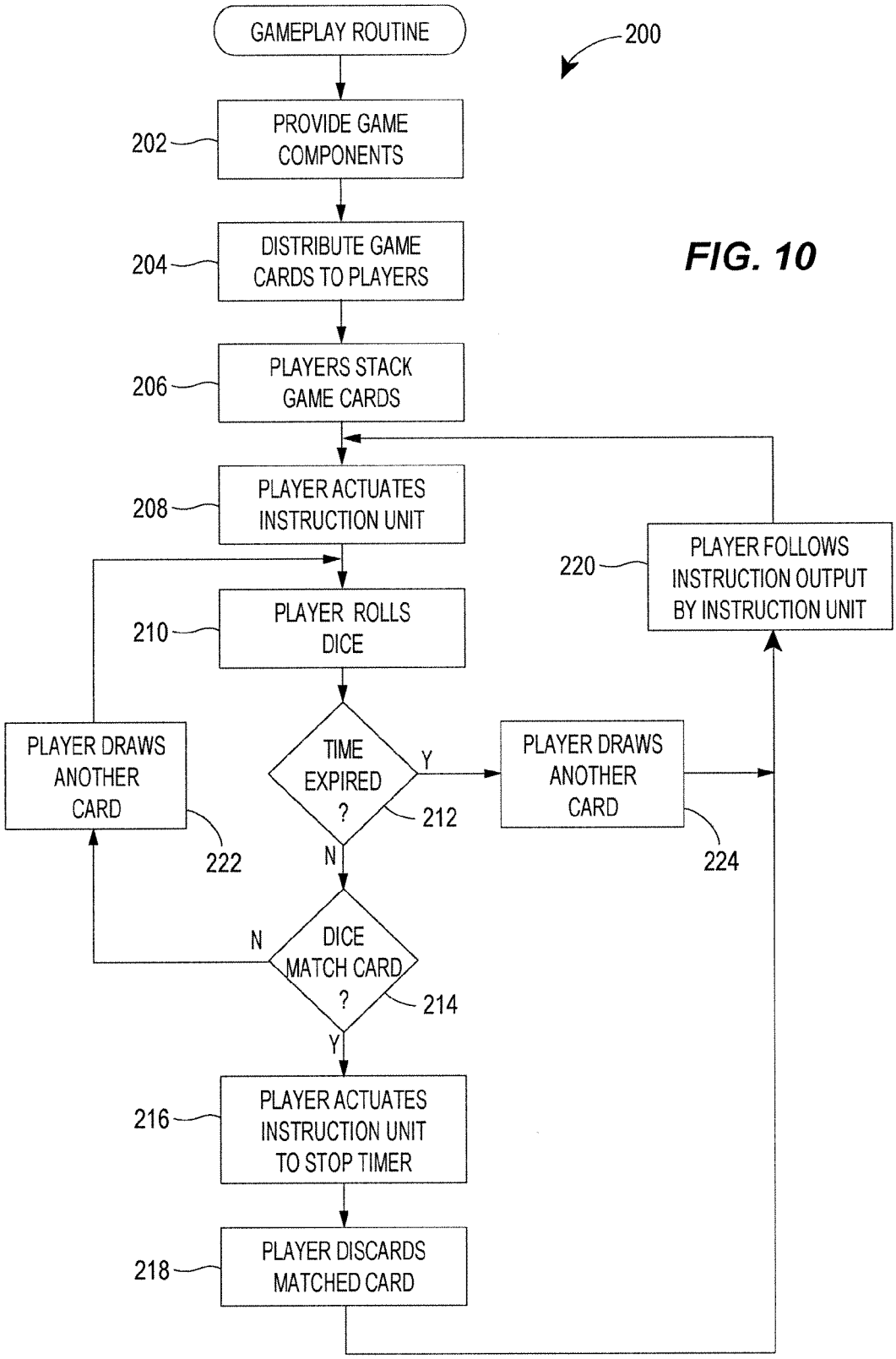
FIG. 10 is a flowchart of an embodiment of a main gameplay routine for a method of gameplay for a plurality of players.

FIGS. 1 and 10 illustrate one possible embodiment of a game 10 and a gameplay routine 200 for a plurality of players having an electronic instruction unit 12 in accordance with the invention. The embodiment of the game 10 illustrated in FIG. 1 is based on the Yahtzee game wherein each player rolls five dice in order to match predetermined combinations of numbers on game cards. In this embodiment of the game 10 and routine 200, the players are dealt cards (FIG. 10, block 204) from a deck of game cards having indicia thereon corresponding to combinations of the dice to be matched by the dice rolls of the players, such as three of a kind, four of a kind, a full house, large and small straights, and other combinations typically used in the traditional Yahtzee game. The players play cards onto a discard pile (FIG. 10, block 218) according to the rules of the game, the rolls of the dice and the indicia on the cards in an effort to play all the cards in the player's hand. During the course of a player's turn, the player actuates the instruction unit 12 to start a timer (FIG. 10, block 208) setting a time within which the player rolls the dice multiple times (FIG. 10, block 210) in an effort to match one of the combinations on the cards in the player's hand. If the player matches a combination on one of the cards (FIG. 10, block 214), the player actuates the instruction unit 12 a second time to stop the timer (FIG. 10, block 216) and to receive a win instruction from the instruction unit 12 (FIG. 10, block 220). If the player does not match any of the combinations on the cards within the time limit (FIG. 10, block 212), the instruction unit 12 outputs a loss instruction to be followed by the player (FIG. 10, block 220). The sequence may continue until one player has discarded all of the game cards in the player's hand onto the discard pile (FIG. 10, block 218), and actuates the instruction unit 12 for a predetermined period of time to signify that the player has won the occurrence of the game. The players may be required to draw another game card 16 (FIG. 10, block 222, 224) if the combination of dice indicia on the top faces of the rolled dice 14 do not match the combinations of dice indicia 40 on the game cards 16 (FIG. 10, block 214) or the instruction unit 12 is not actuated by the player before the expiration of the time period for the player's turn (FIG. 10, block 212).

This embodiment and the drawing figures herein are exemplary only, and are not intended to limit the scope of the claims to this particular embodiment. Other configurations of the game 10 are contemplated having, for example, different electronic instruction units, different dice configurations, different cards and indicia, different gameplay and instruction sequences and game rules, and other variations that are within the scope of the claims defining the invention. Furthermore, it is contemplated that the game 10, in addition to the electronic instruction unit 12, may be implemented partially or entirely through electronic and/or graphic means such that the game layout, game pieces, game cards and audio portions of the game are presented via video or audio technology.

Referring now to FIG. 1, the game 10 may include the electronic instruction unit 12, a plurality of dice 14, a deck of game cards 16, and a storage tray 18 (FIG. 10, block 202). The electronic instruction unit 12 may be any electrical unit capable of receiving an input from a player, and of broadcasting or displaying or otherwise providing via sensory perceptible output an instruction to the players in response to receiving the input from the player. In the illustrated embodiment, the electronic instruction unit 12 may be in the form of a base having a housing 22 enclosing the internal components of the instruction unit 12. In order to receive input from the players, the instruction unit 12 includes an activation button or knob in the form of a large die 22 and a repeat/win button 24 that may be engaged by a player to provide the input to the instruction unit 12. The instruction unit 12 further includes corresponding internal switches (not shown) that are responsive to the engagement and manipulation of the large die 22 and repeat/win button 24 such that the instruction unit 12 is actuated in response. The components and operation of the instruction unit 12, and its use during the game 10, will be discussed more fully hereinafter.

The dice 14 as illustrated are conventional six-sided dice having pips 26 on each face representing the numbers one through six. If desired to assist younger players in recognition of a rolled combination, the faces of the dice 14 may have distinctive colors corresponding to the numbers on the faces. The deck of cards 16 may include a plurality of cards 28-38 having indicia 40 disposed thereon that, along with the rules for the game 10, dictate the way in which the cards 16 may be played by the players during the course of the game 10. As previously discussed, each player may be dealt a plurality of cards 16 from the deck at the start of the game 10. FIG. 1 illustrates different types of cards 16 that may be used in the gameplay for the game 10. The cards 28 (three of a kind), 30 (four of a kind), 32 (full house) and 34 (small straight) represent combinations of the rolled dice 14 that are typically used in the game of Yahtzee. The cards 36, 38 correspond to the Chance category of Yahtzee and reflect combinations of the dice 14 do not fall within one of the other established combinations shown on the cards 28-34. In a standard version of the game, the players must match the particular combination of dice 14 shown on the card 16 with the rolled dice 14 in order to be able to discard the card 16. For example using the illustrated cards 28-38, the player must roll three sixes to match the three of a kind card 28, must roll four ones to match the four of a kind card 30, must roll two threes and three fours to match the full house card 32, must roll a two, three, four and five to match the small straight card 34, must roll a two, two threes and two fours to match the Chance card 36, and must roll a one, three, four, five and six to match the Chance card 38. In an easier version of the game 10 that may be used with younger players that are learning their numbers and who to play the game, the players may match a combination designated by a given card 16 by matching the general combination or category on the card 16. In this version of the game, any roll of the dice 14 resulting in three of a kind matches a three of a kind card 28, regardless of the particular number (1, 2, 3, 4, 5 or 6) that occurs on three of the dice 14.

Other variations in the gameplay rules and the configurations of components may be used and are contemplated by the inventors. For example, alternative configuration of the dice 14 and game cards 16 may be implemented in the game 10. Instead of using numbers on the faces of the dice 14 and the cards 16, the indicia 26, 40 disposed thereon may related to other distinctive items that may be matched and that may correspond to a theme or representation of a franchise that is implemented through the game. Thus, sets of colors, shapes, animals, characters or other items having relation to the game, educational objectives, themes and the like may be substituted for the numbers on the dice 14 and cards 16. As a further alternative, greater or fewer than five dice 14 or greater or fewer than six numbers or other representative items may be used and the combinations on the game cards 16 may be adjusted accordingly. Still further, other mechanisms for randomly selecting the combinations to be matched and/or the combinations of numbers or other items achieved by a player in a roll or simulated roll may be implemented through the instruction unit 12 or other existing or additional components of the game 10. For example, the dice roll may be performed by other random selection mechanism such as one or more Pop-O-Matic type die agitators, other mechanical random selection mechanisms, other electromechanical or electronic random selection mechanisms and the like that may allow a player to repeatedly make random selections from the sets of available game items in an effort to match a predetermined combination or combinations of the game items. Other automated or semi-automated mechanisms will be apparent to those skilled in the art and are contemplated by the inventors as having use in the game 10 in accordance with the present disclosure.

Returning to FIG. 1, the tray 18 of the game 10 may be configured as an open-ended hollow cylinder having a cylindrical outer wall 42 and a bottom 44. The outer wall 42 may be dimensioned to correspond to the outer circumference of the instruction unit 12, and to provide sufficient space to receive the dice 14 and deck of cards 16. In order to secure the instruction unit 12 to the tray 18, the tray 18 may further include inner surfaces defining holes 46 adapted to receive feet 48 on the bottom of the instruction unit 12 and, once the feet 48 are received and the instruction unit 12 is turned, to retentively engage the feet 48 to demountably attach the instruction unit 12 to the tray 18.

At the start of the game 10, the instruction unit 12 may be placed in the center of the playing area (FIG. 10, block 202). The deck of cards 16 may be shuffled, and an equal number of the cards 16 may be dealt out to each player (FIG. 10, block 204). The remaining cards 16 in the deck may be placed face down in the middle of the playing area, and the discard pile. The game may begin by turning on the instruction unit 12 and actuating the unit 12 in a manner described more fully below and players may determine which player goes first by having each player roll one of the dice 14, with the player rolling the highest number going first. On each player's turn, the player presses the large die 22 to actuate the instruction unit 12 and start the timer (FIG. 10, block 208). While the timer is running, the player rolls the dice 14 multiple times (FIG. 10, block 210) in an attempt to match one of the combinations on the cards 16 in the player's hand before the timer expires. Whether the player matches a combination within the time limit (FIG. 10, block 214) or the timer expires (FIG. 10, block 212), the player then follows the corresponding instruction output by the instruction unit 12 (FIG. 10, block 220). The players may be required to draw another game card 16 (FIG. 10, block 222, 224) if the combination of dice indicia on the top faces of the rolled dice 14 do not match the combinations of dice indicia 40 on the game cards 16 (FIG. 10, block 214) or the instruction unit 12 is not actuated by the player before the expiration of the time period for the player's turn (FIG. 10, block 212). Play proceeds with each player in turn pressing the large die 22, rolling the dice 14 to try to match the combinations on the cards 16 in the player's hand, and following the instruction output by the instruction unit 12 (FIG. 10, block 220). The players may be reciuired to draw another game card 16 (FIG. 10, block 222, 224) if the combination of dice indicia on the top faces of the rolled dice 14 do not match the combinations of dice indicia 40 on the game cards 16 (FIG. 10, block 214) or the instruction unit 12 is not actuated by the player before the expiration of the time period for the player's turn (FIG. 10, block 220). The game 10 may continue in this manner until one of the player's plays the last card 16 in the player's hand and presses the large die 22 for a predetermined period of time to signal to the instruction unit 12 that a player won the occurrence of the game.

Figure 2:
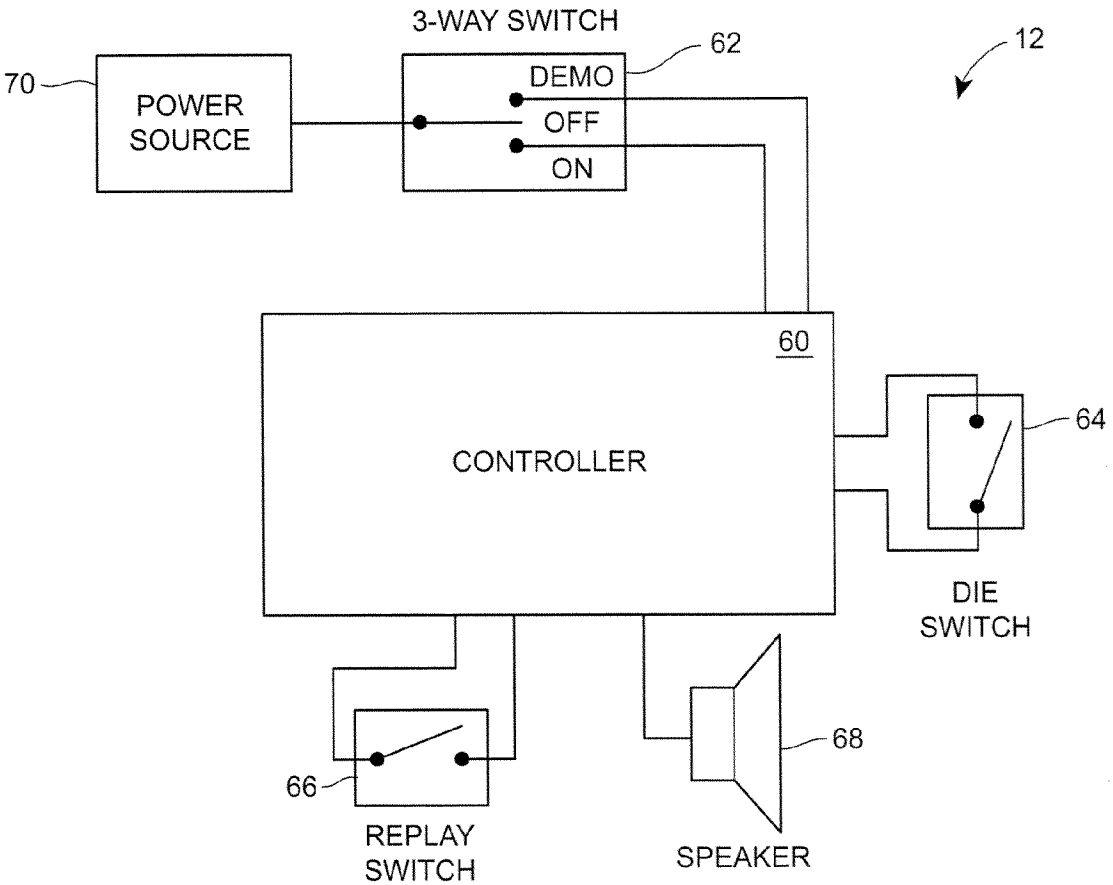
FIG. 2 is a block diagram of the electronic components of the electronic instruction unit for the game of FIG. 1.

The structure of the instruction unit 12 will now be discussed with reference to FIG. 2. FIG. 2 is a block diagram of a number of components that may be incorporated in the instruction unit 12. Referring to FIG. 3, the instruction unit 12 may include a controller 60 containing the game logic and sound generation data implemented via circuitry contained on a conventional printed circuit board, with the game execution logic and sound generation data being stored directly on the printed circuit board. It should be appreciated that although the controller 60 may be implemented on a printed circuit board, more complex implementations of the game 10 may be implemented wherein the controller 60 may comprise, among other components, a program memory, a microcontroller or microprocessor (MP), a random-access memory (RAM), read-only memory (ROM) and an input/output (O) circuit, all of which may be interconnected. It should be appreciated that the controller 60 may include multiple microprocessors. Similarly, the memory of the controller 60 may include multiple RAMs and multiple program memories, depending on the complexity and requirements of a specific implementation. It should also be appreciated that the I/O circuit may include a number of different types of I/O circuits, such as sound generation circuits, video generation circuits, odor generation circuitry, and the like. The RAM(s), ROM(s) and program memories may be implemented as semiconductor memories, magnetically readable memories, and/or optically readable memories, for example.

FIG. 2 illustrates that the controller 60 may be operatively coupled to a three-way mode switch 62, a die switch 64, a replay switch 66 and a speaker 68, each of those components being so coupled via a respective direct line or conductor. In addition, the three-way mode switch 62 may be operatively coupled to a power source 70. Different connection schemes could be used. The three-way mode switch 62 may be coupled to the controller 60 such that the instruction unit 12 may operate in a demonstration mode when the switch 62 is set to the "DEMO" position, may operate in a gameplay mode when the switch is set to the "ON" position, and may be powered off when the switch 62 is set to the "OFF" position. The operation of the instruction unit 12 in the demonstration and gameplay modes is discussed more fully below.

When the three-way mode switch 62 is set to either the "DEMO" position or the "ON" position, the controller 60 may be connected to the power source 70, which may be batteries inserted into a battery compartment of the instruction unit 12, an external battery, a power cord connected to a wall outlet, or any other appropriate source of electrical power, such that the power source 70 may provide power to the controller 60, circuitry and other components 64-68. Input signals produced by the die switch 64 and the replay switch 66 are output to the controller 60 for processing by the game execution logic in both the demonstration and the gameplay modes. Depending on the processing performed, the circuitry of the controller 60 generates and outputs sound generation signals to the speaker 68, wherein the speaker 68 translates the output signals into sounds that are broadcast through holes in the housing 22 of the instruction unit 12 such that the sounds may be heard by the participants of the game 10. The controller 60 may store data files containing the information necessary to generate the sound generation signals for the sounds used in the game 10. FIGS. 3A and 3B illustrate a table 80 of sound files that may be stored by the controller 60 for use during the game 10. The table 80 includes a file number 82 for each sound file that will be used for reference during subsequent discussions herein, a filename 84 under which the files may be stored, a sound type 86 for the sound contained in the sound file (e.g., MUS=music, SFX=sound effects, NAR=verbal sounds or narration, or combinations such as MUS/NAR), the spoken phrase/description 88 of the generated sound, and an estimated time 90 for playing back the sound generated from the particular sound file. When a particular sound or sounds are required as described below, the controller 60 reads the corresponding sound file(s) and uses the data therein to generate the sound generation signals. The general and specific technologies relating to electronic sound generation circuitry, and the software required to run such devices, are well known to those skilled in the electronic and software arts, and therefore the specific details of the digital processing and memory portions of such circuitry, and the specific details of any software required for this specific application will not be described further herein except as may be necessary.

While the output device or mechanism for the instruction unit 12 is illustrated herein as the speaker 108 which may broadcast game instructions that may be audibly perceptible to the players, those skilled in the art will understand that the instruction unit 12 may be implemented with an desired output device capable of conveying the game instructions in any manner that may be perceptible to the players. For example, in an alternative embodiment, the output device for the instruction unit 12 may be a visual display for the game instructions that may be viewable by the players to convey the game instructions. As a further alternative, the output device may be a printer to which the controller 60 may output signals causing the printer to print and dispense game instructions when a player presses the large die 22 and/or the replay button 24. Other output devices or mechanisms may be implemented in the instruction unit 12 as desired, and are contemplated by the inventor as having use with the game 10 and instruction unit 12 of the present invention.

As previously discussed, the controller 60 receives input signals from the switches 64, 66, and the input signals cause the controller 60 to process the game execution logic in the demonstration and gameplay modes. In one embodiment of the instruction unit 12, the switches 64, 66 may be micro switches disposed within the housing 22 of the instruction unit 12 and configured to be actuated in response to displacement of the large die 22 and the replay button 24, respectively. When the large die 22 and replay button 24 are in their normal positions, the micro switches 64, 66 are not actuated and do not transmit input signals to the controller 60. During the course of the game 10, the player may actuate the micro switches 64, 66 and, correspondingly, activate the instruction unit 12. With the micro switches 64, 66 actuated, input signals are transmitted to the controller 60 to thereby cause the controller 60 to process the demonstration or game execution logic stored thereon.

While the micro switches 64, 66 are discussed herein as transmitting input signals to the controller 60 indicating the actuation of the micro switches 64, 66, those skilled in the art will understand that the micro switches 64, 66 may be configured to transmit a continuous input signal when the micro switches 64, 66 are in their normal positions, and discontinue the input signals when the micro switches 64, 66 are actuated, thereby informing the controller 60 of the input from the players by the absence of input signals from the micro switches 64, 66. Further, while the switches 64, 66 are described herein as micro switches, the switches 64, 66 may be implemented via any type of switch or other input mechanism that may detect input at the instruction unit 12 by a player. For example, the die switch 64 may be an optical sensor configured to transmit input signals to the controller 60 indicating the proximity of a player's hand to the instruction unit 12 when the player's hand covers the optical sensor. As a further alternative, the replay switch 66 may be implemented via a switch that detects the pressure from the player on the replay button 24, either directly or via some other mechanism capable of applying pressure to the switch 66 in response to an input by the player. Those skilled in the art will understand that other mechanisms for detecting an input by the player and causing an input signal or otherwise activating the controller 60 to process the game execution logic may be implemented in an instruction unit 12, and are contemplated as having use with the present invention.

As previously discussed, the instruction unit 12 may operate in either a demonstration mode or a gameplay mode. In order to activate the instruction unit in the demonstration mode, the three-way switch 62 may be moved to the "DEMO" position, thereby causing the controller 60 to execute the demonstration mode logic programmed therein. While in the demonstration mode, the controller 60 may be programmed to transmit one of a plurality of available sound generation signals to the speaker 108 in response to detecting the activation of the die switch 64. The available sounds for the demonstration mode may be contained in the sound files of table 80, and may be formed by concatenating the sounds from several of the sound files to form phrases and sentences. FIG. 4 is a demonstration mode phrase table 92 containing a plurality of phrases that may be output by the instruction unit 12 when the large die 22 is pressed. The table 92 includes an occurrence number 94 for each phrase, a listing of the file numbers 96 from table 80 that are combined to generate the phrase, and a phrase description 98. The controller 60 may cause the sound generation signals for the phrases in table 92 to be output to the speaker 68 according to the occurrence number 94 when the die switch 64 is actuated and the switch 64 is in the DEMO position. For example, during the demonstration mode, the logic programmed into the controller 60 may cause the controller 60 to play the phrase formed by file numbers 01 (power on music), 08 ("Let's play") and 09 ("Yahtzee Turbo") the first time the large die 22 is pressed, the phrase formed by file numbers 12 ("Let's roll"), 03 (timer music) and 06 (ding sound effect) the second time the large die 22 is pressed, and the phrase formed by file numbers 45 ("Way to go!), 67 (Yahtzee fanfare music), 19 ("Discard"), 20 ("your top card"), 21 ("and") and 22 ("use 3 rolls only to try for a Yahtzee"). If the large die 22 is subsequently pressed, the controller 60 may continue to cycle through the demonstration mode phrases in table 92. Once the phrase is selected, the controller 60 outputs the corresponding sound generation signals to the speaker 68 for broadcasting to the person pressing the large die 22 to induce the person to purchase the game 10. Those skilled in the art will appreciate that the implemented strategy of storing sound files containing single words or short phrases that may be used in multiple instruction phrases instead of storing sound files containing each complete instruction phrase may reduce the amount of storage required in the controller 60 and, consequently, reduce the cost of the controller 60.

Figure 5A:
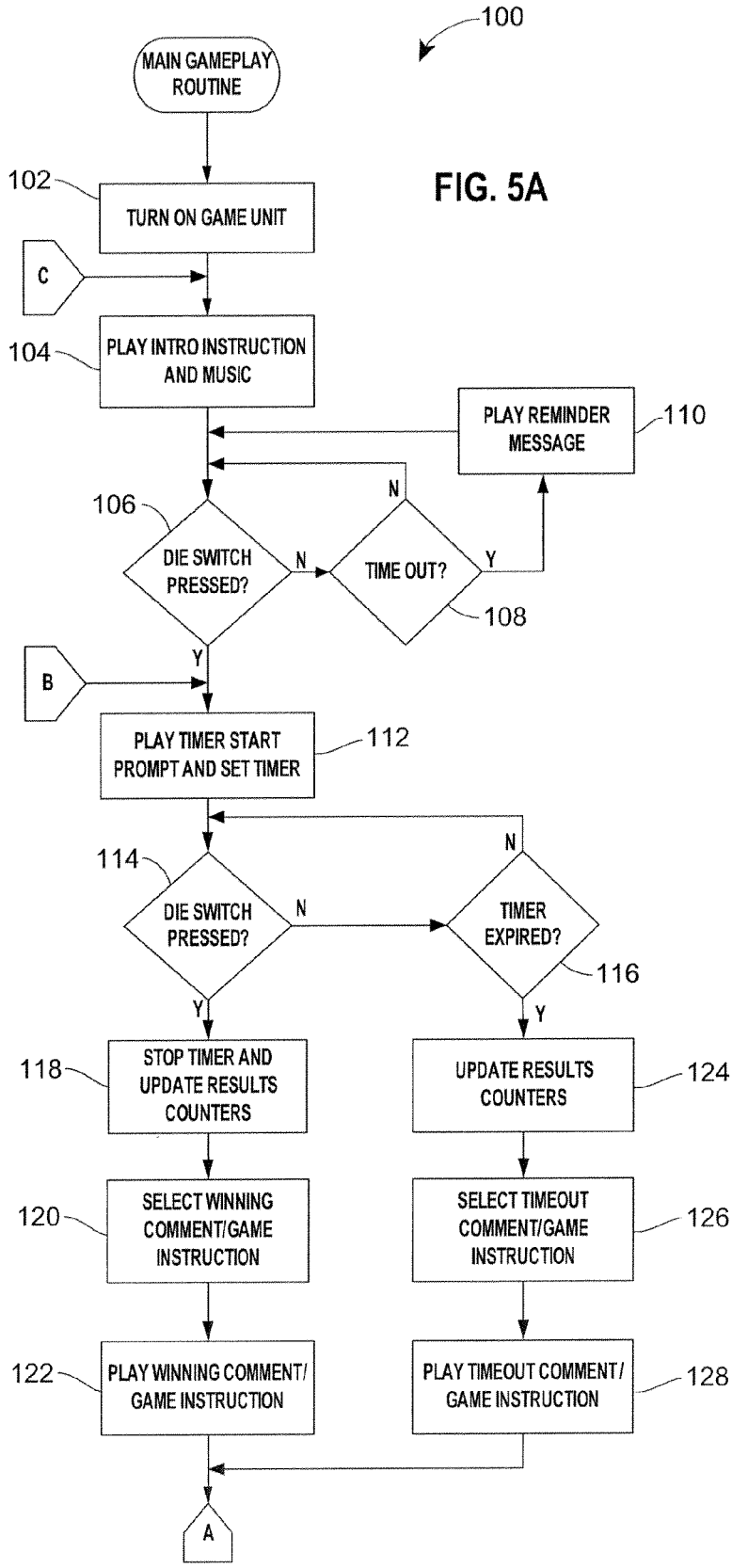
FIGS. 5A and 5B are a flowchart of an embodiment of a main gameplay routine that may be performed by the electronic instruction unit during the game.
Figure 5B:
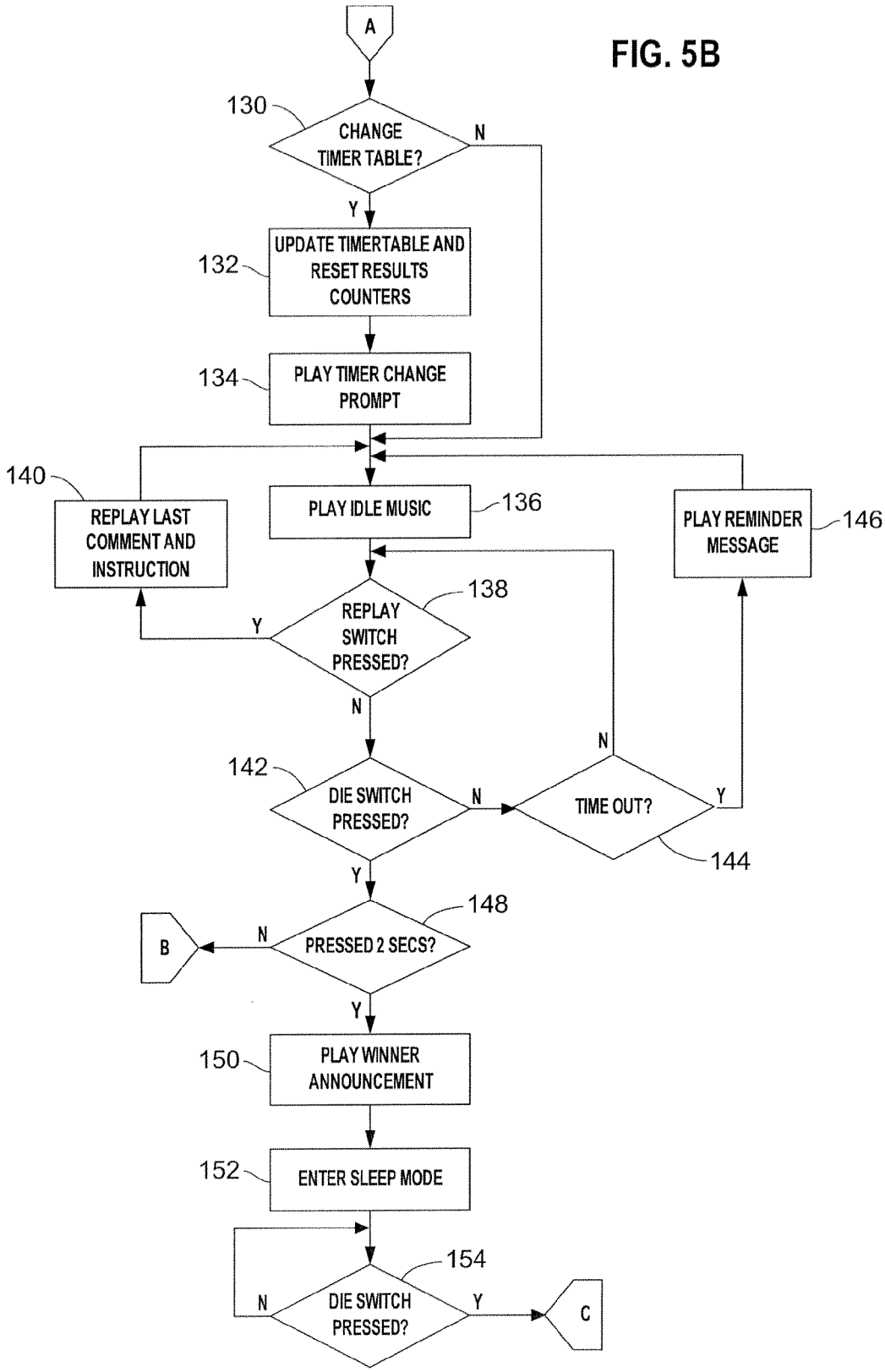

FIGS. 5A and 5B are a flowchart of a main gameplay routine 100 that may be stored in the memory of the controller 60 and executed when the instruction unit 12 is in the gameplay mode. The main gameplay routine 100 may begin operation at a block 102 wherein the three-way switch 62 of the instruction unit 12 may be moved to the "ON" position by a player. After the three-way switch 62 is set to the "ON" position, control may pass to a block 104 wherein the controller 60 may output the sound generation signals for an introductory instruction and idle music to the speaker 68. For example, the introductory instruction may be the combination of file numbers 01 (power up introductory music), 08 ("Let's play"), 09 (game name: "Yahtzee Turbo"), and 11 ("Tap the big die once to start") from table 80, and may be followed by the idle music of file number 02 played in a continuous loop while the controller 60 awaits the actuation of the die switch 64 in response to a player tapping the large die 22. In preparation for the beginning of the game, each player is dealt a predetermined number of cards, such as 3-5 cards (FIG. 10, block 208), which the players stack in any order and place face up in front of them (FIG. 10, block 206).

After broadcasting the introductory phrase, control may pass to a block 106 where the controller 60 may initialize a timer and evaluate whether the large die 22 of the instruction unit 12 has been pressed by a player and, correspondingly, the die switch 64 has been actuated. If the large die 22 is not pressed, control may pass to a block 108 wherein the controller 60 may determine whether a predetermined wait time has elapsed on the timer. If the wait time has not elapsed, control may return to the block 106 for the controller 60 to wait for a player to press the large die 22. If the wait time has elapsed at the block 108, control may pass to a block 110 wherein the controller 60 may output sound generation signals to the speaker 68 to cause the speaker 68 to output a reminder message for the players, such as the phrase formed by the combination of file numbers 10 ("Don't forget") and 11 ("Tap the big die once to start") of table 80, followed by the idle music of file number 02. After playing the reminder phrase at the block 110, control passes back to the block 106 to continue waiting for actuation of the die switch 64. Eventually, after a predetermined period of inactivity and several reminder messages, the controller 60 may cause the instruction unit 12 to enter a shut down mode and further wait for a player to press the large die 22 and actuate the die switch 64. As long as the controller 60 does not detect actuation of the die switch 64, the controller 60 may remain in the shut down mode. When the controller 60 finally detects the actuation of the die switch 64, control may pass back to the block 104 wherein the introductory phrase may be replayed to start the occurrence of the game anew.

Once a player presses the large die 22 during their turn (FIG. 10, block 208) and the controller 60 detects the actuation of the die switch 64 at the block 106, control passes to a block 112 wherein the controller 60 plays a timer start prompt, selects a time period for the player's turn, and sets a timer for the selected time period. The controller 60 may output sound generation signals to the speaker 68 with the timer start prompt for the player, such as the phrase formed by the combination of file numbers 12 ("Let's roll") and 13 ("Ready? Go!") of table 80, followed by the timer music of file number 03, 60 or 61 played in a continuous loop. The time period for the turn may be selected in any manner by the controller 60 from any number of possible time periods. In the simplest implementation, the time period may be a predetermined fixed amount of time for every turn. Alternatively, the controller 60 may be programmed with a random number generator to randomly select from a predetermined range of time periods.

As a further alternative, in the illustrated embodiment the time period is selected from a predetermined discrete set of time periods stored by the controller 60. FIG. 6 shows a plurality of tables 160, 162, 164 of time possible time periods that may be selected by the controller 60. Table 160 includes a default set of time periods that may be selected by the controller 160, table 162 includes a set of shorter time periods that may be used when the players demonstrate the ability to consistently complete their turns within the time periods of table 160, and table 164 includes a set of longer timer periods that may be used when the players consistently fail to complete their turns within the time periods of table 160. In this embodiment, the controller 60 may switch to the faster tables 160, 162 after three consecutive successful turns by the players, and may switch to the slower tables 160, 164 after three consecutive unsuccessful turns. In order to track which table 160, 162 or 164 to use, the controller 60 stores counters and a table pointer that are updated during the course of the occurrence of the game. Back at the blocks 102, 104 when the instruction unit 12 is turned on or when a new occurrence of the game begins, the controller 60 may further be configured to initialize the counters and table pointer by setting a successful turn counter and an unsuccessful turn counter to zero, and initializes the table pointer to initially point to table 160. Subsequently, the controller 60 reads the table pointer to determine the table from which to select the time period for the player's turn.

At the first occurrence of the block 112, the counters will be set to zero, the table pointer will be set to table 160, and the controller 60 will not have selected a time period from the table 160. Under these conditions, the controller 60 randomly selects one of the time periods from table 160 for use in the first turn of the occurrence of the game. In subsequent selections from table 160 at the block 112, the controller 60 continues selecting time periods sequentially through table 160 and loops back to the beginning after the last time period is selected. Similarly, the first selection by the controller 60 from one of the tables 162, 164 is a random selection from the available time periods. Also at the block 112, the controller 60 determines the timer music file to use based on the table 160, 162, 164 at which the table pointer is pointing. Each of file numbers 03, 60, 61 corresponds to one of the tables 160, 162, 164 respectively, with the music of file number 60 having a faster tempo than the music of file number 03, and the music of file number 61 having a slower tempo than the music of file number 03.

Once the controller 60 plays the start timer prompt and timer music, and selects the time period and sets the timer at the block 112, control passes to a block 114 wherein the controller 60 determines whether the die switch 64 is actuated in response to the large die 22 being pressed by the player after rolling a combination of the dice that matches the combination on the card 16 on the top of the player's pile (FIG. 10, block 216). If the controller 60 does not detect the actuation of the die switch 64, control passes to a block 116 wherein the controller 60 determines whether the timer has expired. If the timer has not expired, control passes back to the block 114 to again determine whether the die switch 64 is actuated as the player continues rolling the dice 14 in an effort to match the combination on the topmost card 16.

If the controller 60 detects actuation of the die switch 64 at the block 114 before determining that the timer has expired at the block 116, control passes to a block 118 wherein the controller 60 stops the timer and updates the results counters for the timer tables 160, 162, 164. Because the player successfully completed the turn, the controller 60 increments the successful turn counter. At the same time, the controller 60 resets the unsuccessful turn counter to zero so that the players must again have three unsuccessful turns before the controller 60 switches to using one of the slower time period tables 160, 164. After the controller 60 updates the timer table counters, control passes to a block 120 wherein the controller 60 selects winning comment and instruction reflecting the player's successful completion of the turn. In the illustrated embodiment, the controller 60 is preprogrammed with a plurality of comment and instruction combinations formed by the sound files of table 80 stored in the instruction unit 12. FIG. 7 is a winning phrase table 170 having a plurality of winning comments and instructions from which the controller 60 selects after a successful turn. The winning phrase table 170 includes winning phrase numbers 172, the file numbers 174 combined to generate the phrases, and a description of the phrases 176 resulting from the concatenated files. On the first execution of the block 120 during the occurrence of the game, the controller 60 randomly selects one of the phrases from table 170. In subsequent executions, the controller 60 proceeds down the table 170 and loops around to the top of the table 170 when the bottom of the table 170 is reached. Alternatively, the controller 60 may randomly select one of the phrases from table 170 during each execution of the block 120.

As will be apparent from inspection of the table 170, the players may be instructed to perform various actions and combinations of actions upon the successful completion of the turn, such as discarding their top card, passing the dice 14 to the next player (phrase numbers 1, 4-6, 9-12, 15 and 16), taking another turn (phrase numbers 3, 7 and 13), and attempting to roll a Yahtzee (all five dice 14 having the same number/color) within three rolls (phrase numbers 2, 8 and 14)(FIG. 10, block 220). The Yahtzee instructions are particularly long, so it may be desired to expedite the game by shortening the instruction as the players become more familiar with the rules. This may be accomplished by programming the controller 60 with a table 180 as illustrated in FIG. 8 containing a series of phrases for the Yahtzee instruction that are further abbreviated in each subsequent occurrence of the Yahtzee instruction. The table 180 includes a phrase occurrence number 182, the file numbers 184 from table 80 that are combined to form the instruction, and a description of the resulting instruction phrase 186 generated from the files. The first occurrence 182 of the Yahtzee instruction uses all the sound files as specified for phrase numbers 2, 8 and 14 of table 170, the second occurrence drops file number 64 ("Don't use the timer"), the third occurrence drops file number 66 ("after 3 rolls"), and the fourth occurrence drops file number 63 ("If all 5 dice are the same color, discard another card"). Each time the controller 60 selects a Yahtzee instruction at the block 120 during the occurrence of the game, the controller 60 then selects the next occurrence of the instruction from table 180 to be output at the speaker 68. Once the fourth occurrence of the Yahtzee instruction is selected, the controller 60 will continue to use the fourth occurrence each time the Yahtzee instruction is selected until the end of the game. After the controller 60 selects the comment and instruction from table 170 at the block 120, control passes to a block 122 wherein the controller 60 passes sound generation signals to the speaker 68 for the selected winning comment and instruction.

If the controller 60 does not detect actuation of the die switch 64 at the block 114 and determines that the timer has expired at the block 116, control passes to a block 124 wherein the controller 60 updates the results counters for the timer tables 160, 162, 164 to reflect the unsuccessful completion of the turn. Because the player did not successfully complete the turn, the controller 60 increments the unsuccessful turn counter. At the same time, the controller 60 resets the successful turn counter to zero so that the players must again have three successful turns before the controller 60 switches to using one of the faster time period tables 160, 162. After the controller 60 updates the timer table counters, control passes to a block 126 wherein the controller 60 selects timeout comment and instruction reflecting the player's unsuccessful completion of the turn. In the illustrated embodiment, the controller 60 is preprogrammed with a plurality of comment and instruction combinations formed by the sound files of table 80 stored in the instruction unit 12. FIG. 9 is a timeout phrase table 190 having a plurality of timeout comments and instructions from which the controller 60 selects after an unsuccessful turn. The timeout phrase table 190 includes timeout phrase numbers 192, the file numbers 194 combined to generate the phrases, and a description of the phrases 196 resulting from the concatenated files. On the first execution of the block 126 during the occurrence of the game, the controller 60 randomly selects one of the phrases from table 190. In subsequent executions, the controller 60 proceeds down the table 190 and loops around to the top of the table 190 when the bottom of the table 190 is reached. Alternatively, the controller 60 may randomly select one of the phrases from table 190 during each execution of the block 126. After the controller 60 selects the comment and instruction from table 190 at the block 126, control passes to a block 128 wherein the controller 60 passes sound generation signals to the speaker 68 for the selected timeout comment and instruction (FIG. 10, block 220).

After the winning comment and instruction is played at the block 122, or the timeout comment and instruction is played at the block 128, control passes to a block 130 of FIG. 5B wherein the controller 60 determines whether the gameplay routine 100 should use a faster or a slower timer table. As previously discussed, the timer table is changed after a predetermined number of consecutive successful or unsuccessful turns by the players, such as after three consecutive turns. Therefore, the controller 60 evaluates the successful and unsuccessful turn counters to determine whether either counter has a value of "3." If one of the counters has a value of "3," the controller 60 must also evaluate whether there is a faster or slower table available. If the successful turn counter has a value of "3," the controller 60 can switch to a faster table only if the table pointer indicates that table 160 or 164 is currently being used. Conversely, if the unsuccessful turn counter has a value of "3," the controller 60 can switch to a slower table only if the table pointer indicates that table 160 or 162 is currently being used.

If neither counter has a value of "3," or if a faster or slower timer table is not available, the gameplay routine continues without changing the timer table. If the controller 60 determines that one of the counters has a value of "3" at the block 130, control passes to a block 132 wherein the controller 60 updates the timer table and resets the results counters. If the successful turn counter has a value of "3" and the table pointer is set to the default table 160, the controller 60 sets the table pointer to the fast table 162. If the successful turn counter has a value of "3" and the table pointer is set to the slow table 164, the controller 60 sets the table pointer to the default table 160. If the unsuccessful turn counter has a value of "3" and the table pointer is set to the default table 160, the controller 60 sets the table pointer to the slow table 164. Finally, if the unsuccessful turn counter has a value of "3" and the table pointer is set to the fast table 162, the controller 60 sets the table pointer to the default table 160. In addition to changing the table pointer, the controller 60 resets the successful and unsuccessful turn counters to zero.

After setting the table pointer and resetting the counters, control passes to a block 134 wherein the controller 60 causes the speaker 68 to output a timer change prompt informing the players that the time periods for their turns will be sped up or slowed down, depending on the change that is made to the table pointer. For example, if the controller 60 is speeding up the game by changing from the slow table 164 to the default table 160, or from the default table 160 to the fast table 162, the timer change prompt may be formed from file numbers 14 ("That's three times in a row"), 15 ("you beat the clock") and 16 ("I'm going to speed things up a bit") from table 80. Similarly, if the controller 60 is slowing down the game by changing from the fast table 162 to the default table 160, or from the default table 160 to the slow table 164, the timer change prompt may be formed from file numbers 14, 17 ("the clock has won") and 18 ("I think it's time to slow things down") from table 80.

After the controller 60 determines whether to change the timer table and, if necessary, changes the table pointer, control passes to a block 136 to play the idle music of file number 02 in a continuous loop as the instruction unit 12 waits for further input from the players. While the idle music is output by the speaker 68, control passes to a block 138 to determine whether the replay switch 66 is actuated by a player to replay the last instruction. If the controller 60 detects that the replay switch 66 is actuated, control passes to a block 140 wherein the controller 60 will again transmit sound generation signals to the speaker 68 to repeat the selected winning or timeout comment and instruction. After replaying the comment and instruction, control passes back to the block 136 to again play the idle music in a continuous loop until a further input is received from the players.

If the controller 60 does not detect the actuation of the replay switch 66 at the block 138, control passes to a block 142 to determine whether the die switch 64 has been actuated. If the die switch 64 has not been actuated, control passes to a block 144 to determine whether a predetermined period of time has elapsed since the instruction unit 12 began outputting the idle music. If the period of time has not elapsed, control passes back to the blocks 138, 142 to again determine whether either the replay switch 66 or the die switch 64, respectively, has been actuated. If the controller 60 determines that the period of time has elapsed at the block 144, control passes to a block 146 wherein the controller 60 may output sound generation signals to the speaker 68 to cause the speaker 68 to output a reminder message for the players. After the instruction unit 12 outputs the reminder message, control passes back to the block 136 to again play the idle music in a continuous loop, and then to the blocks 138, 142 to again determine whether either the replay switch 66 or the die switch 64, respectively, has been actuated.

When the controller 60 detects actuation of the die switch 64 at the block 142, control passes to a block 148 to determine how long the die switch 64 is actuated. A player wins the occurrence of the game when they discard the last card 16 from their pile. In order to signal to the instruction unit 12 that a player has won the game, the player presses the large die 22 for at least two seconds. Consequently, if a player presses the die switch 64 for less than two seconds at the block 148, the player is initiating another turn for the same occurrence of the game, and control passes back to the block 112 to play the start timer prompt, to select a time period for the turn and to set the timer. If the controller 60 detects actuation of the die switch 64 for at least two seconds at the block 148, control passes to a block 150 wherein the controller 60 outputs sound generation signals to the speaker 68 to play fanfare music and a game winner announcement that may be stored in file number 05 of table 80. After outputting the game winner announcement, control passes to a block 152 wherein the controller 60 enters a sleep mode to conserve power, and to a block 154 wherein the controller 60 waits for the die switch 64 to be actuated by a player to initiate another occurrence of the game. If the die switch 64 is not actuated, the instruction unit 12 remains in the sleep mode. If the die switch 64 is actuated, control passes back to the block 104 to initiate another occurrence of the game.

The flowcharts illustrate one embodiment of a main gameplay routine that may be programmed into the controller 60 or other memory of the instruction unit 12, and executed by the controller 60. Those skilled in the art will understand that other routines may be implemented in the instruction unit 12 to provide a desired gameplay for the game 10. For example, the controller 60 of the instruction unit 12 may be programmed to randomly select from the winning and timeout comments and instructions stored at the instruction unit 12 instead of selecting the instructions sequentially after randomly selecting the first comment and instruction as described above. Moreover, the instruction unit 12 may be programmed with other sound files and composite phrases formed from the sound files, and with more or alternate timer tables, for use during the main gameplay routine 100. Such alternative routines and stored information are contemplated by the inventors as having use with the game 10 and instruction unit 12 of the present invention.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A method of gameplay for a game for a plurality of players, the method comprising:

providing an instruction unit, a plurality of dice each having dice indicia disposed on the faces thereof and a deck of game cards, wherein each game card has gameplay indicia comprising a combination of the dice indicia disposed thereon;

distributing a plurality of the game cards to each participant of the game;

each player in turn actuating the instruction unit to initiate a timer with a time period for the player's turn;

rolling the dice during the time period until the combination of dice indicia on the top faces of the rolled dice matches the combination of dice indicia on one of the game cards distributed to the player or until the time period for the player's turn expires; and the player actuating the instruction unit a second time to stop the timer if the combination of dice indicia on the top faces of the rolled dice matches the combination of dice indicia on one of the game cards distributed to the player.

2. A method of gameplay for a game as defined in claim 1, comprising:

discarding the matched game card if the combination of dice indicia on the top faces of the rolled dice matches the combination of dice indicia on the game card and the instruction unit is actuated by the player before the expiration of the time period for the player's turn; and drawings another game card if the combination of dice indicia on the top faces of the rolled dice do not match the combinations of dice indicia on the game cards or the instruction unit is not actuated by the player before the expiration of the time period for the player's turn.

3. A method of gameplay for a game as defined in claim 1, comprising:

each player stacking the game cards distributed to them in a pile and placing the pile face up in front them; and rolling the dice during the time period until the combination of dice indicia on the top faces of the rolled dice matches the combination of dice indicia on the top game card on the pile in front of the player.

4. A method of gameplay for a game as defined in claim 1, comprising outputting a winning instruction from the instruction unit in response to detecting actuation of the instruction unit after the timer is initiated and before the expiration of the time period for the player's turn.

5. A method of gameplay for a game as defined in claim 4, wherein a first set of time periods and a second set of time periods are stored in the instruction unit, and wherein the durations of the time periods in the second set are shorter than the durations of the time periods in the first set, the method comprising:

initially selecting time periods from the first set each time the instruction unit is actuated to initiate the timer; and selecting time periods from the second set after a predetermined number of consecutive occurrences of players actuating the instruction unit after the timer is initiated and before the expiration of the selected time period for the player's turn.

6. A method for gameplay for a game as defined in claim 1, comprising outputting a timeout instruction from the instruction unit in response to the expiration of the time period for the player's turn without detecting actuation of the instruction unit after the timer is initiated.

7. A method for gameplay for a game as defined in claim 6, wherein a first set of time periods and a second set of time periods are stored in the instruction unit, and wherein the durations of the time periods in the second set are longer than the durations of the time periods in the first set, the method comprising:

initially selecting time periods from the first set each time the instruction unit is actuated to initiate the timer; and selecting time periods from the second set after a predetermined number of consecutive occurrences of the expiration of the selected time period for the player's turn without detecting actuation of the instruction unit after the timer is initiated.

8. A method of gameplay for a game for a plurality of players, the method comprising:

distributing a plurality of game cards to each player of the game, wherein each game card has gameplay indicia comprising a combination of dice indicia disposed on the faces of a plurality of dice;

sequential players actuating an instruction unit to initiate a time period for the player's turn;

rolling the dice during the time period in an attempt to match the combination of dice indicia on one of the game cards with the combination of indicia on the top faces of the rolled dice;

actuating the instruction unit if the combination of dice indicia on the top faces of the rolled dice matches the combination of dice indicia on one of the game cards before the time period for the player's turn expires; and following the game instructions output by the instruction unit, wherein the game instructions are determined based on whether the player actuated the instruction unit a second time before the expiration of the time period.

9. A method of gameplay for a game as defined in claim 8, comprising:

stacking the game cards distributed to the players in piles and placing the piles face up in front the players; and rolling the dice during the time period until the combination of dice indicia on the top faces of the rolled dice matches the combination of dice indicia on the top game card on the pile in front of the player.

10. A method of gameplay for a game as defined in claim 8, comprising outputting a winning instruction from the instruction unit in response to detecting actuation of the instruction unit after the timer is initiated and before the expiration of the time period for the player's turn.

11. A method of gameplay for a game as defined in claim 10, wherein a first set of time periods and a second set of time periods are stored in the instruction unit, and wherein the durations of the time periods in the second set are shorter than the durations of the time periods in the first set, the method comprising:

initially selecting time periods from the first set each time the instruction unit is actuated to initiate the timer; and selecting time periods from the second set after a predetermined number of consecutive occurrences of players actuating the instruction unit after the timer is initiated and before the expiration of the selected time period for the player's turn.

12. A method for gameplay for a game as defined in claim 8, comprising outputting a timeout instruction from the instruction unit in response to the expiration of the time period for the player's turn without detecting actuation of the instruction unit after the timer is initiated.

13. A method for gameplay for a game as defined in claim 12, wherein a first set of time periods and a second set of time periods are stored in the instruction unit, and wherein the durations of the time periods in the second set are longer than the durations of the time periods in the first set, the method comprising:

initially selecting time periods from the first set each time the instruction unit is actuated to initiate the timer; and selecting time periods from the second set after a predetermined number of consecutive occurrences of the expiration of the selected time period for the player's turn without detecting actuation of the instruction unit after the timer is initiated; and following the game instruction output by the instruction unit.

* * * * *

UNITED STATES PATENT AND TRADEMARK OFFICE

CERTIFICATE OF CORRECTION

PATENT NO. : 7,410,170 B1
APPLICATION NO. : 11/426420
DATED : August 12, 2008
INVENTOR(S) : Alan Roach et al.

It is certified that error appears in the above-identified patent and that said Letters Patent is hereby corrected as shown below:

On the Title Page:

At field (73), second Assignee, "LLC." should be -- LLC --.

In the Claims:

At Column 15, line 63, "drawings" should be -- drawing --.

Signed and Sealed this

Third Day of March, 2009

JOHN DOLL
*Acting Director of the United States Patent and Trademark Office*